US010767852B1

(12) United States Patent
Ebert

(10) Patent No.: US 10,767,852 B1
(45) Date of Patent: Sep. 8, 2020

(54) PORTABLE STORAGE CASE AND LIGHTING ASSEMBLY

(71) Applicant: EDC, Inc., Kernersville, NC (US)

(72) Inventor: Keith A. Ebert, Kernersville, NC (US)

(73) Assignee: EDC, Inc., Kenersville, NC (US)

( * ) Notice: Subject to any disclaimer, the term of this patent is extended or adjusted under 35 U.S.C. 154(b) by 0 days.

(21) Appl. No.: 16/378,938

(22) Filed: Apr. 9, 2019

(51) Int. Cl.

| | |
|---|---|
| ***F21V 33/00*** | (2006.01) |
| ***G10G 7/00*** | (2006.01) |
| ***F21V 23/00*** | (2015.01) |
| ***F21V 23/04*** | (2006.01) |
| ***F41C 33/06*** | (2006.01) |

(52) U.S. Cl.
CPC ..... *F21V 33/0056* (2013.01); *F21V 23/005* (2013.01); *F21V 23/0414* (2013.01); *F21V 33/0076* (2013.01); *F41C 33/06* (2013.01); *G10G 7/005* (2013.01)

(58) Field of Classification Search
CPC . G10G 7/005; F21V 33/0004; F21V 33/0012; F21V 33/002; F21V 33/0024; F21V 33/0028; F21V 33/0048; F21V 33/008; F21V 33/0084; F21V 23/0442; F21V 23/04; F21V 23/0492; F21V 33/0056; F21V 33/0076; F21V 23/0414; F21V 23/005; F41C 33/06
See application file for complete search history.

(56) References Cited

U.S. PATENT DOCUMENTS

| | | | | | |
|---|---|---|---|---|---|
| 1,189,592 | A * | 7/1916 | Lutz | A45C 15/06 | 362/155 |
| 2,644,882 | A * | 7/1953 | Voda | F25D 27/00 | 362/94 |
| 3,937,320 | A * | 2/1976 | Chao | A45C 11/16 | 206/216 |
| 5,153,561 | A * | 10/1992 | Johnson | A45C 13/24 | 190/101 |
| 6,033,084 | A * | 3/2000 | Burke | A47G 29/1212 | 362/155 |
| 7,850,326 | B2 * | 12/2010 | Herper | A47B 97/00 | 362/127 |
| 9,671,158 | B1 * | 6/2017 | Sandberg | F25D 27/005 | |
| 9,726,424 | B1 * | 8/2017 | Sandberg | F25D 27/005 | |
| 9,743,494 | B1 * | 8/2017 | McCrory | H05B 37/0227 | |
| 9,970,610 | B1 * | 5/2018 | Sandberg | F21S 9/03 | |
| 10,088,144 | B1 * | 10/2018 | Sandberg | B65D 81/3813 | |
| 10,203,154 | B1 * | 2/2019 | Wyatt | F25D 27/005 | |

(Continued)

OTHER PUBLICATIONS

Electrical Guitar Case: LED Edition, Mar. 25, 2019, 6 pages. https://gatorcases.com/products/guitar/led-cases/tsa-ata-guitar-cases/tsa-guitar/electric-guitar-case-led-gtsa-gtrelec-led/.

*Primary Examiner* — Erin Kryukova
(74) *Attorney, Agent, or Firm* — Dority & Manning, P.A.

(57) ABSTRACT

A portable storage case may include a case body, a lid, a lighting assembly, and a nonmechanical field switch. The case body may define a storage chamber. The lid may be rotatably mounted to the case body to move between an open position and a closed position. The open position may permit access to the storage chamber. The closed position may restrict access to the storage chamber. The lighting assembly may be attached to one of the lid and the case body. The nonmechanical field switch may be in electrical communication with the lighting assembly to restrict activation of the lighting assembly in the closed position.

19 Claims, 6 Drawing Sheets

(56) References Cited

U.S. PATENT DOCUMENTS

| | | | | |
|---|---|---|---|---|
| 2006/0028820 | A1* | 2/2006 | Fitzsimmons | A01K 97/06 362/276 |
| 2007/0115653 | A1* | 5/2007 | Cea | A45C 11/16 362/104 |
| 2007/0217187 | A1* | 9/2007 | Blakely | F25D 27/00 362/154 |
| 2007/0241259 | A1* | 10/2007 | Pandorf | F21V 23/0442 250/214 AL |
| 2008/0170388 | A1* | 7/2008 | Greil | F25D 27/00 362/155 |
| 2009/0158770 | A1* | 6/2009 | Cohrs | F25D 23/12 62/457.9 |
| 2009/0200183 | A1* | 8/2009 | Dussin | A45C 11/16 206/6.1 |
| 2009/0290331 | A1* | 11/2009 | Jacobs | A45C 15/06 362/155 |
| 2010/0212344 | A1* | 8/2010 | Mattucci | F25D 27/00 62/264 |
| 2010/0242520 | A1* | 9/2010 | Weir | F25D 27/00 62/264 |
| 2013/0033854 | A1* | 2/2013 | Statham | F25D 27/00 362/154 |
| 2014/0009906 | A1* | 1/2014 | Rolfes | F25D 27/00 362/92 |
| 2015/0219389 | A1* | 8/2015 | Schaefer | F25D 27/00 362/94 |
| 2018/0087764 | A1* | 3/2018 | Davenport | F25D 27/005 |
| 2019/0343257 | A1* | 11/2019 | Ragans | A45C 15/06 |

* cited by examiner

PORTABLE STORAGE CASE AND LIGHTING ASSEMBLY

FIELD OF THE INVENTION

The present subject matter relates generally to a portable storage case and lighting assembly to selectively illuminate the same.

BACKGROUND OF THE INVENTION

Portable storage cases, as their name implies, are generally provided for enclosing and facilitating the transport of one or more articles therein. Typical examples of portable storage cases may be adapted for one or more particular articles, such as a musical instrument or personal firearm. Generally, such cases include one or more solid (e.g., nonpermeable) walls that define an enclosed volume or chamber in which one or more articles may be stored. The walls may serve to protect the articles within the enclosed volume (e.g., from fluids, air, dirt, impact, etc.) as the portable case is moved or transported.

Although conventional portable storage cases offer number of advantages, certain long-standing drawbacks often remain an issue. For instance, it can often be difficult to see the contents of a portable storage case, even when the case is open. The sidewalls of the portable case may block light such that the enclosed volume of the portable storage case is less well-lit in the surrounding environment. Additionally or alternatively, a user may wish to open and view the contents of a portable storage case in a dim or poorly lit environment. As an example, a musician or instrument technician may wish to examine a specific instrument within a portable instrument case in a dimly lit backstage environment at a concert or performance (e.g., to ensure proper tuning of the instrument). As another example, an individual may wish to examine personal firearm at night without turning on the lights or fixtures of a given room (e.g., in order to covertly retrieve the firearm for self-defense).

In order to overcome these drawbacks, users have typically been forced to provide a flashlight or other light source that is independent storage case. However, this approach is generally cumbersome and can still fail to adequately illuminate an internal region of the portable storage case. In some cases, light fixtures have been secured to a portion of a portable storage case. Nonetheless, a user is generally still required to find and activate a switch for the light fixture, which can be inconvenient and require additional time.

As a result, it would be advantageous to provide a portable storage case or lighting assembly addressing one or more of the above identified issues.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a portable storage case is provided. The portable storage case may include a case body, a lid, a lighting assembly, and a nonmechanical field switch. The case body may define a storage chamber. The lid may be rotatably mounted to the case body to move between an open position and a closed position. The open position may permit access to the storage chamber. The closed position may restrict access to the storage chamber. The lighting assembly may be attached to one of the lid and the case body. The nonmechanical field switch may be in electrical communication with the lighting assembly to restrict activation of the lighting assembly in the closed position.

In another exemplary aspect of the present disclosure, a portable storage case is provided. The portable storage case may include a case body, a lid, a lighting assembly, and a nonmechanical field switch. The case body may define a storage chamber. The lid may be rotatably mounted to the case body to move between an open position and a closed position. The open position may permit access to the storage chamber. The closed position may restrict access to the storage chamber. The lighting assembly may be attached to one of the lid and the case body. The nonmechanical field switch may include a magnetic reed switch attached to the lid in electrical communication with the lighting assembly to restrict activation of the lighting assembly in the closed position.

In yet another exemplary aspect of the present disclosure, a portable storage case is provided. The portable storage case may include a case body, a lid, a plurality of lighting assemblies, and a nonmechanical field switch. The case body may define a storage chamber. The lid may be rotatably mounted to the case body to move between an open position and a closed position. The open position may permit access to the storage chamber. The closed position may restrict access to the storage chamber. The plurality of lighting assemblies may be attached to one of the lid and the case body. Each lighting assembly of the plurality of lighting assembles may be spaced apart from the other. The nonmechanical field switch may be in electrical communication with the lighting assembly to restrict activation of the lighting assembly in the closed position.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
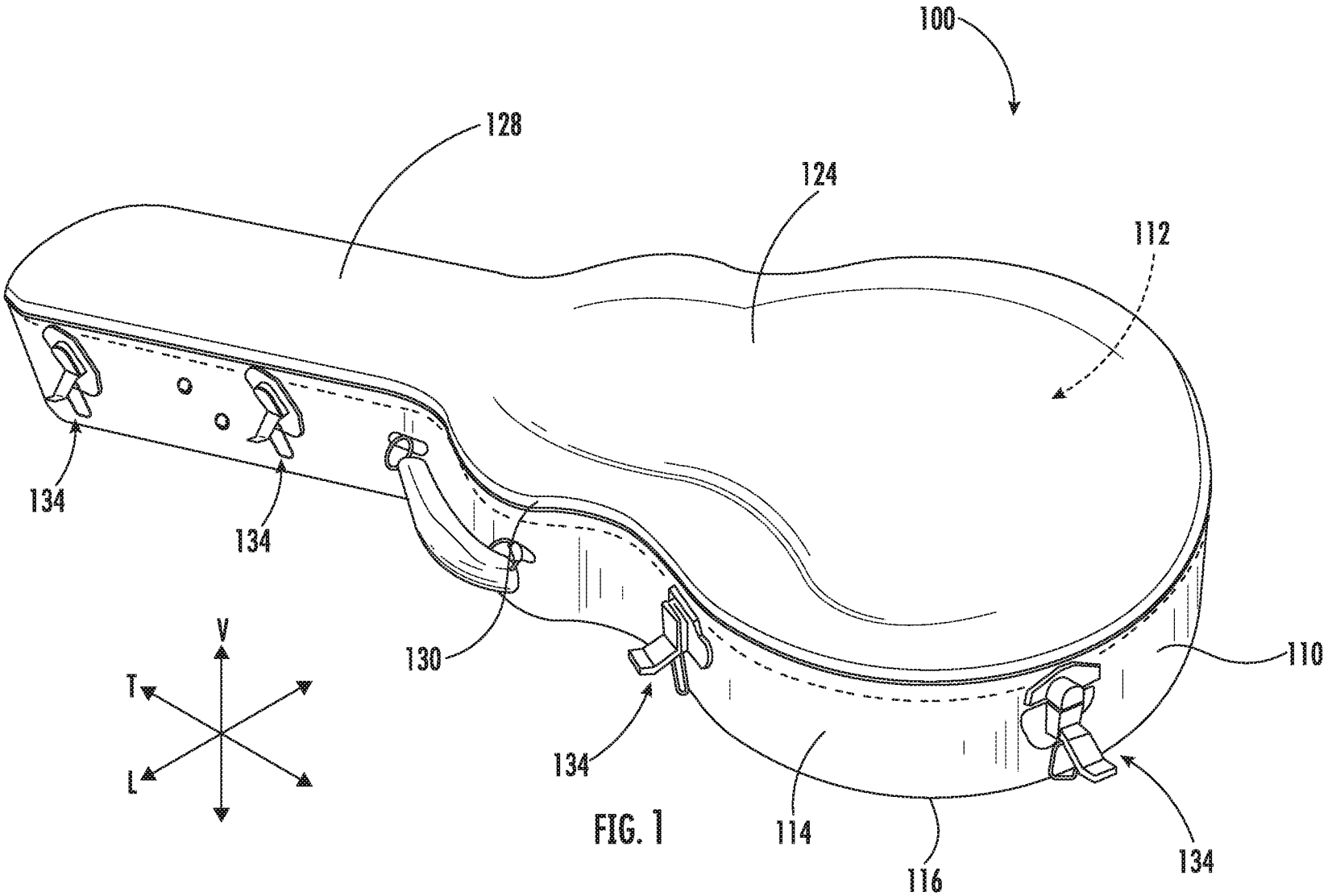
FIG. 1 provides a perspective view of a portable storage case according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
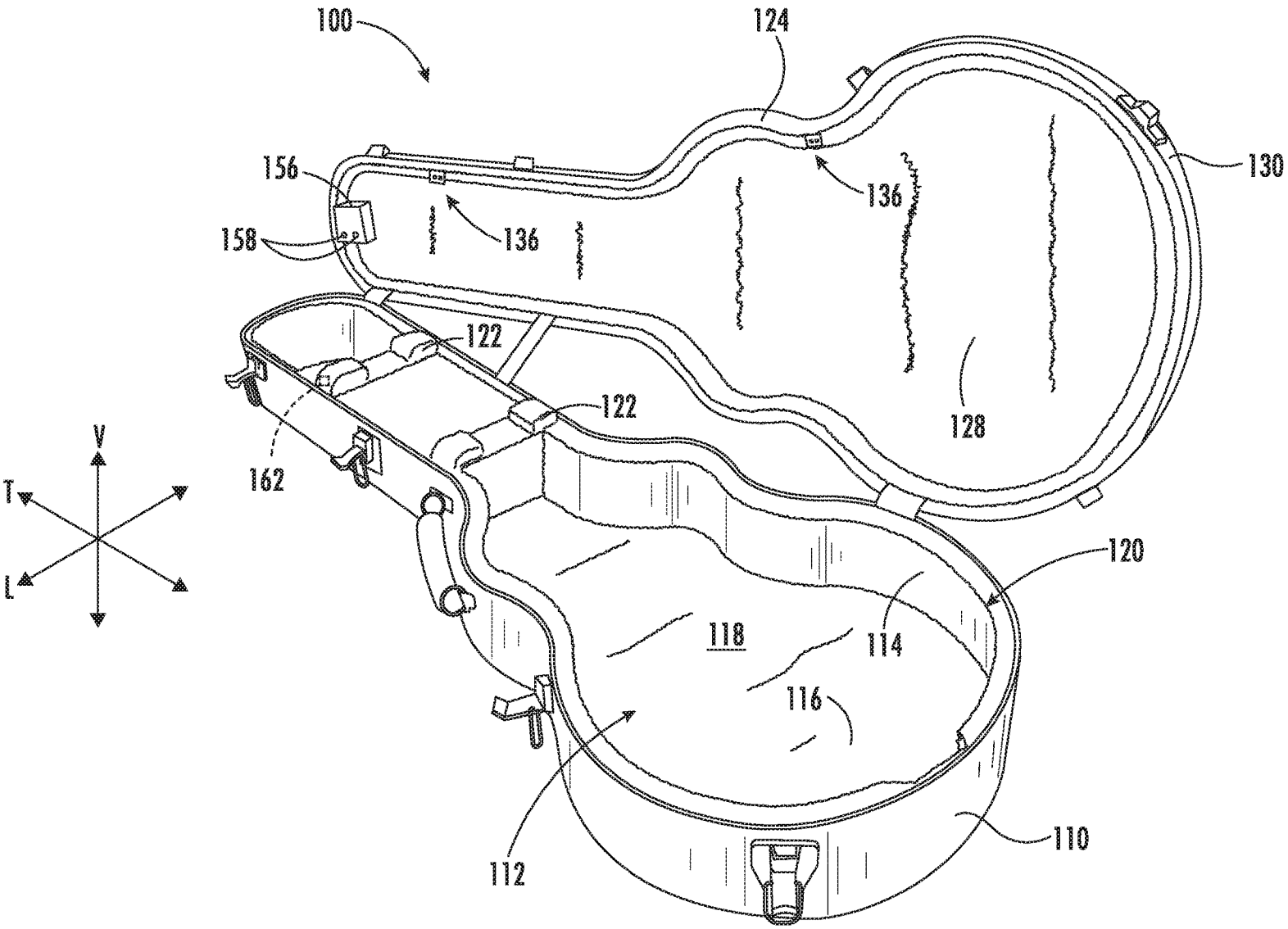
FIG. 2 provides a perspective view of the exemplary portable storage case of FIG. 1, wherein a lid is shown in an open position.
Figure 3:
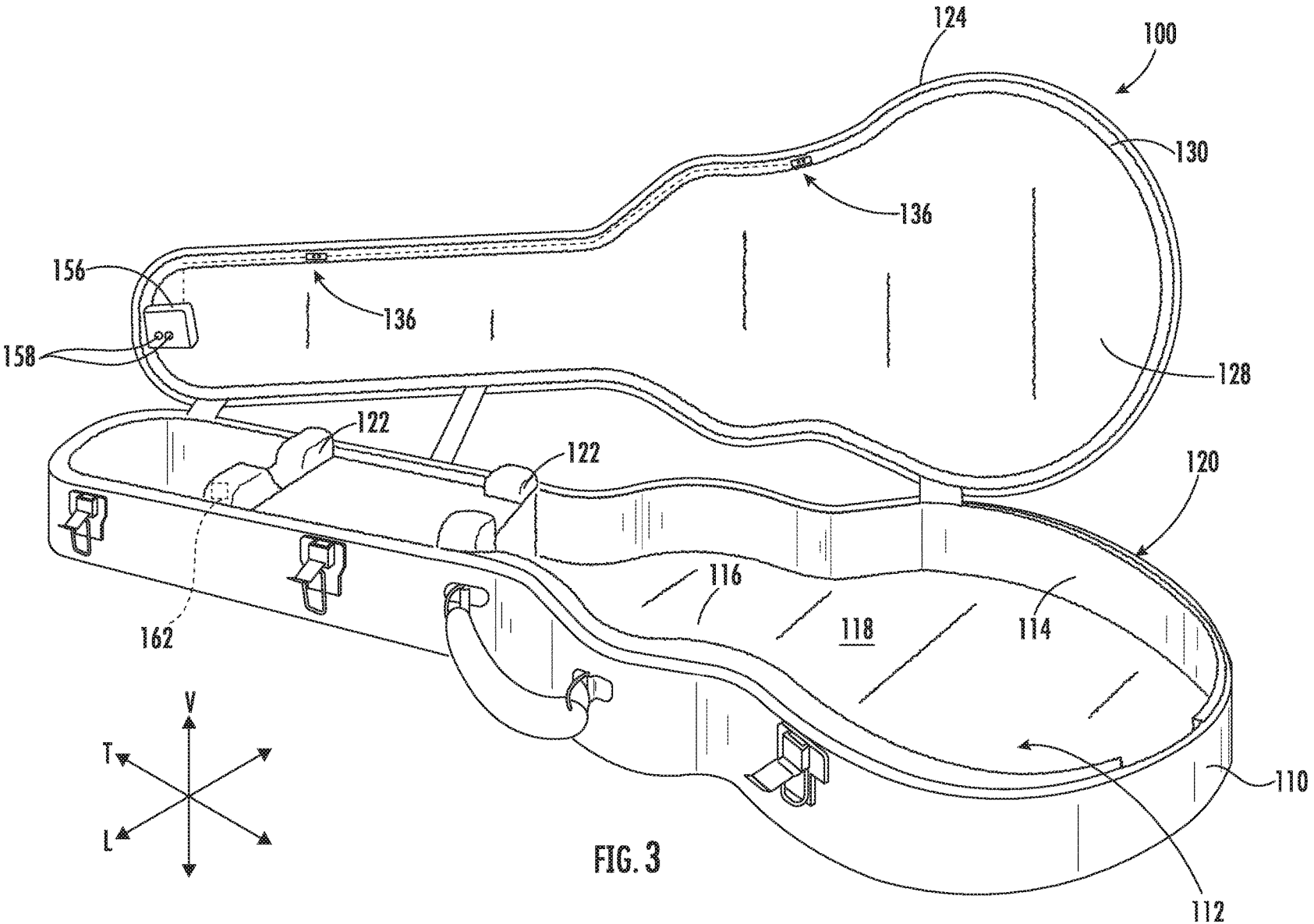
FIG. 3 provides another perspective view of the exemplary portable storage case of FIG. 1, wherein a lid is shown in an open position.
Figure 4:
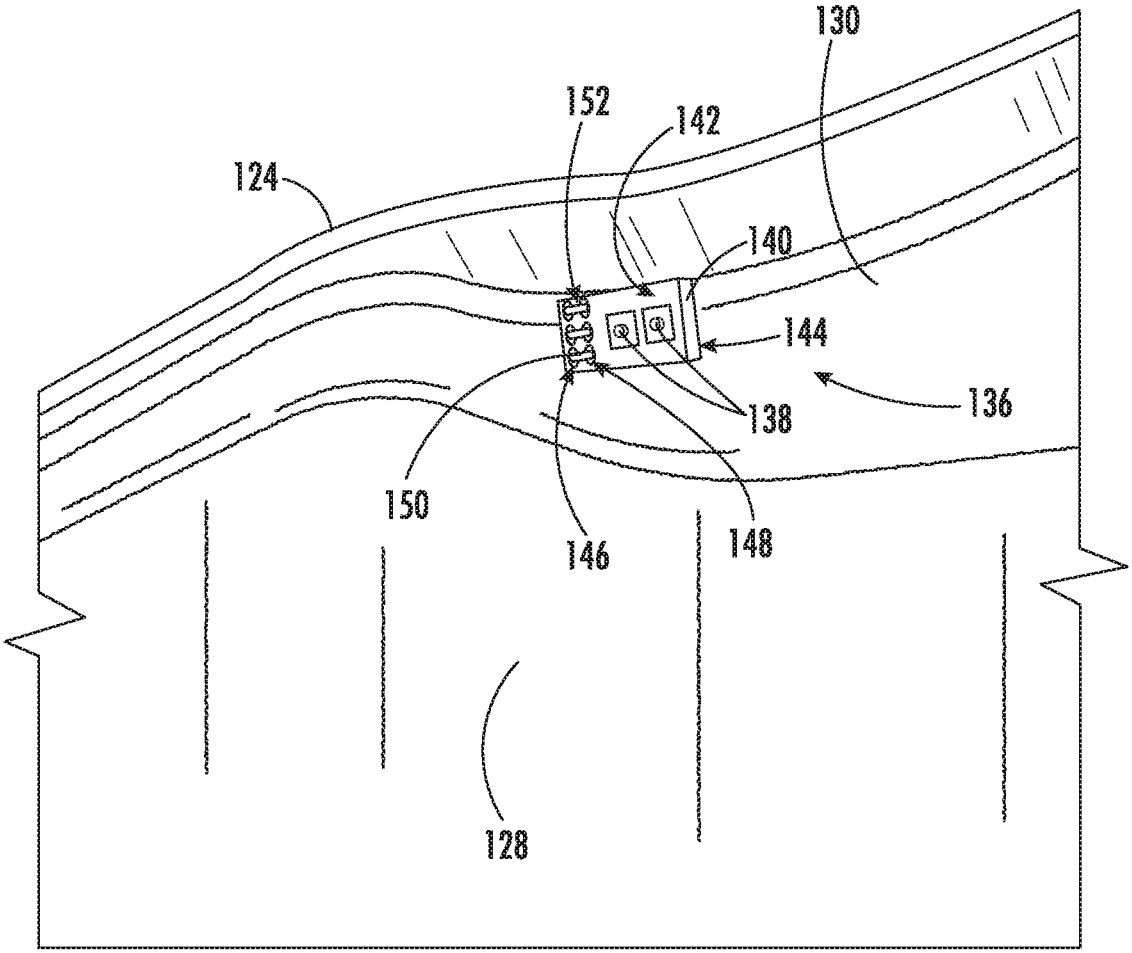
FIG. 4 provides a magnified perspective view of a lighting assembly of the exemplary portable storage case of FIG. 1, wherein a lid is shown in an open position.
Figure 5:
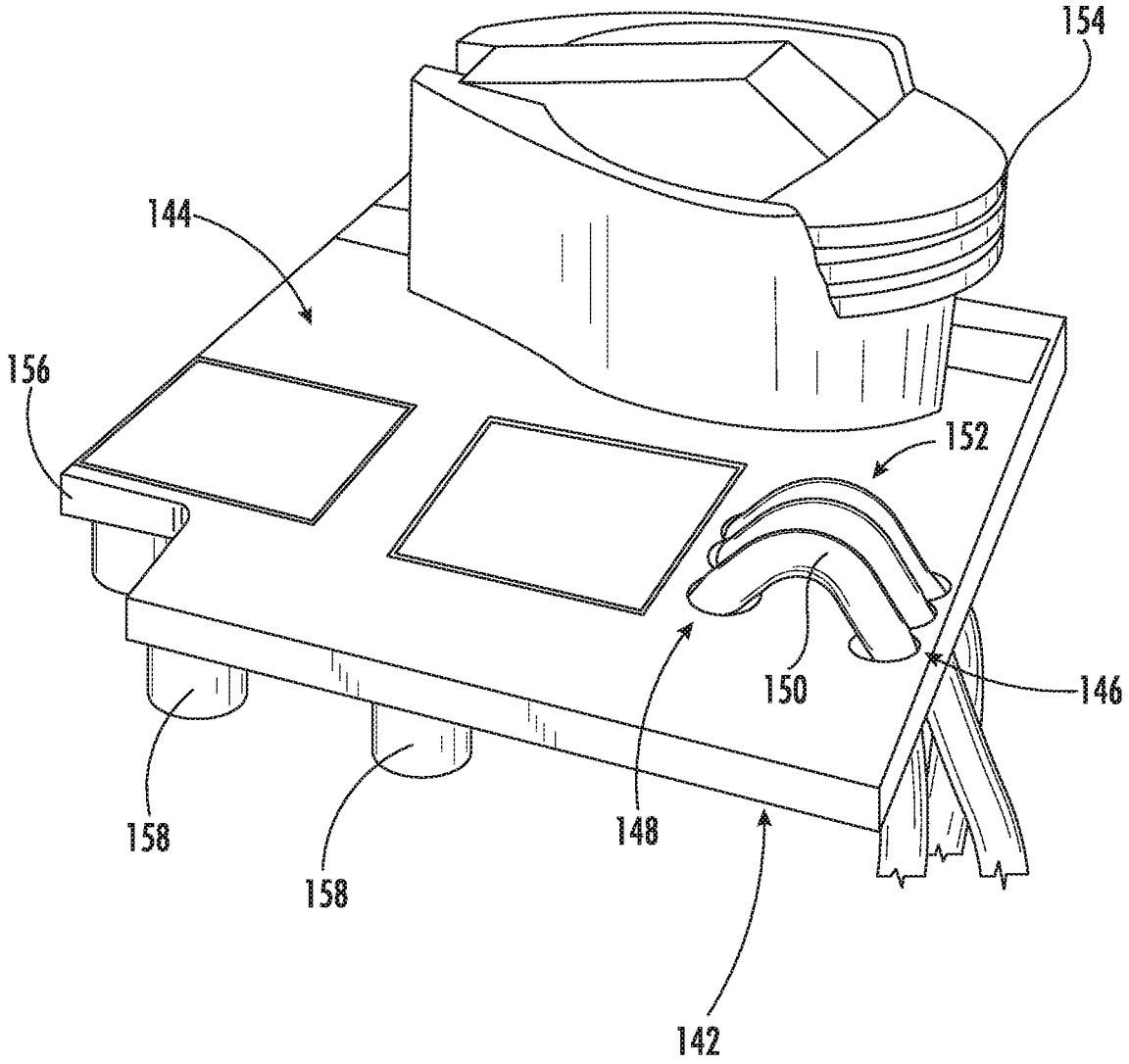
FIG. 5 provides a rear perspective view of a lighting assembly in isolation according to exemplary embodiments of the present disclosure.

Turning now to the figures, FIGS. 1 through 3 provides various views of a portable storage case 100 according to exemplary embodiments of the present disclosure. As shown, portable storage case 100 generally includes a case body 110 defining a mutually-orthogonal vertical direction V, lateral direction L, and transverse direction T.

One or more walls (e.g., solid or nonpermeable walls through which the passage of air or water is not permitted) of case body 110 define, at least in part, a storage chamber 112 within which various articles may be received. In exemplary embodiments, case body 110 includes a sidewall 114 and a bottom wall 116 that together define a body volume 118 of storage chamber 112. For instance, an inner or interior surface of bottom wall 116 may define one or more vertical extrema of storage chamber 112, while in an inner or interior surface of sidewall 114 may define one or more horizontal extrema (i.e., in the lateral direction L and the transverse direction T) of storage chamber 112. A case opening 120 may further be defined by case body 110 (e.g., by sidewall 114) in fluid communication with body volume 118.

In certain embodiments, an internal wall 122 extends from case body 110. For instance, internal wall 122 may extend generally along the vertical direction V from sidewall 114 or bottom wall 116 (e.g., to separate a portion of body volume 118 or provide an additional, elevated support surface for articles within storage chamber 112). In some such embodiments, internal wall 122 extends above the case opening 120 (e.g., from bottom wall 116). An uppermost surface of internal wall 122 may thus be provided at a location that is higher than an uppermost surface of sidewall 114 along or relative to the vertical direction V.

In optional embodiments, case body 110 and storage chamber 112 are shaped according to a specific article be received or enclosed within portable storage case 100 (i.e., as a negative or complementary shape to the specific article). As shown in the illustrated embodiments, the specific article may be a musical instrument, such as a guitar. In this manner, exemplary embodiments of the present disclosure may be described as a guitar case. However, it is understood that the present disclosure is not limited to such embodiments and may provide any suitable shape within case body 110 or storage chamber 112. As an example, alternative embodiments may be shaped according to a personal firearm and may, thus, be described as a portable gun case. As another example, further alternative embodiments may be formed as a generic enclosure defining a storage chamber 112 that is shaped as a rectangular prism. Further embodiments may be provided as any other suitable shape.

Figure 7:
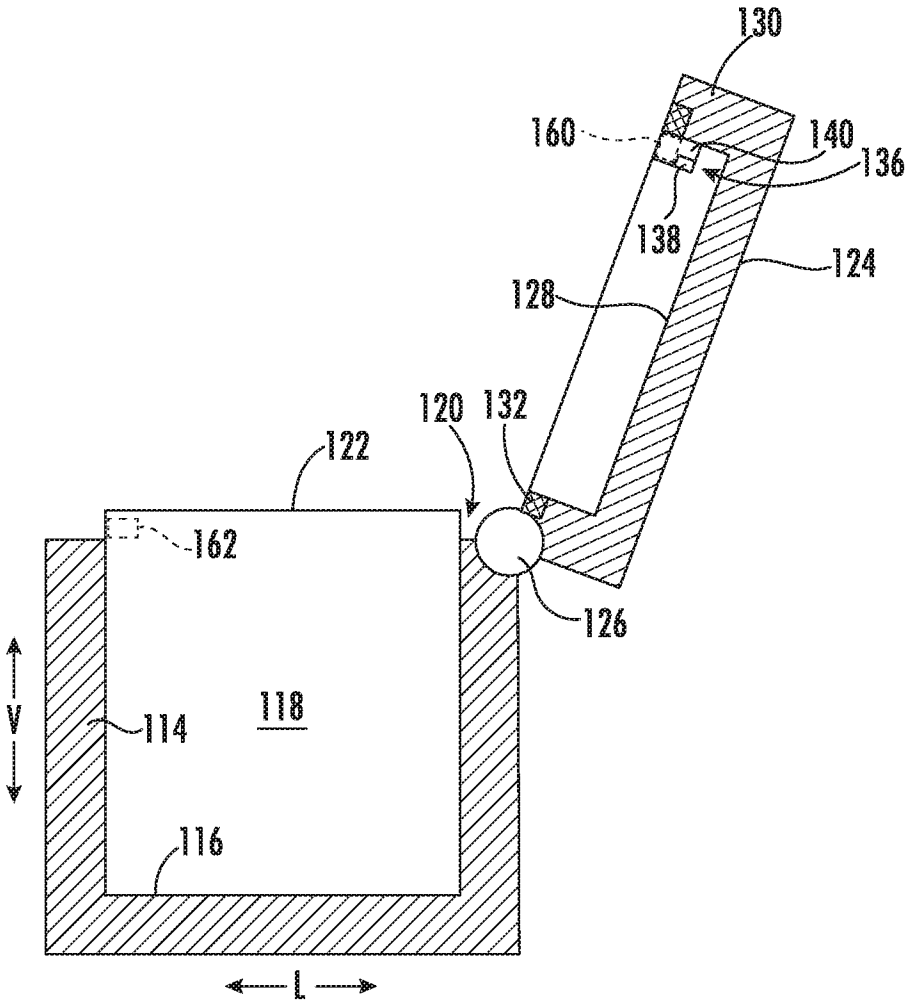
FIG. 7 provides a cross-sectional schematic view of the exemplary portable storage case of FIG. 6, wherein the lid is shown in an open position.
Figure 6:
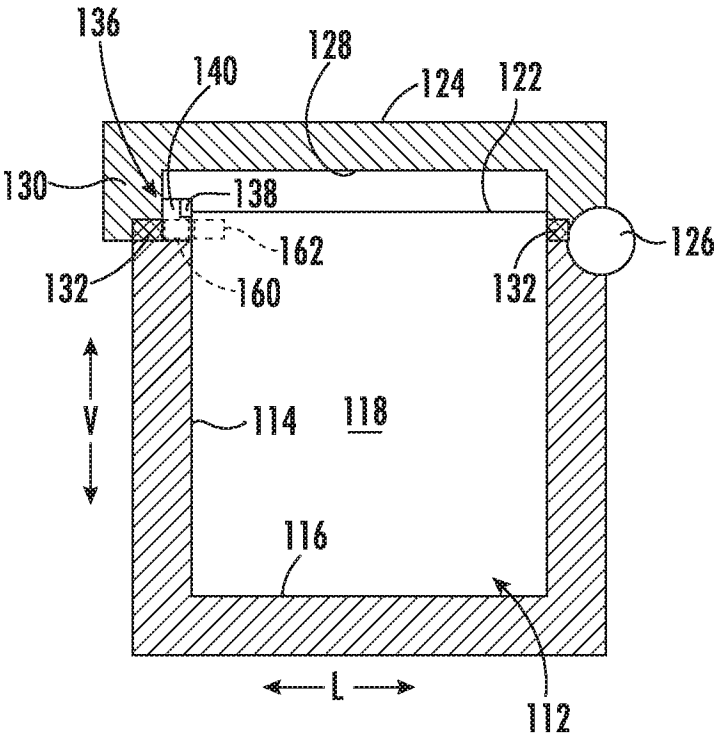
FIG. 6 provides a cross-sectional schematic view of a portable storage case according to exemplary embodiments of the present disclosure, wherein the lid is shown in a closed position.

In some embodiments, a lid 124 is rotatably mounted to case body 110 (e.g., by one or more hinges 126—FIGS. 6 and 7—defining an axis of rotation). In some embodiments, lid 124 includes a top wall 128 positioned above, for instance, body volume 118. When assembled, lid 124 may selectively open and close storage chamber 112. Specifically, lid 124 may move (e.g., by rotating about the axis of rotation) between an open position (FIG. 2) and a closed position (FIG. 1). In the open position, access to storage chamber 112 is generally permitted. For instance at least a portion of lid 124 may be spaced apart from case opening 120 such that a user may insert or remove articles from storage chamber 112 through case opening 120. In the closed position, access to storage chamber 112 is restricted. For instance, top wall 128 of lid 124 may span across case opening 120 above body volume 118 and may contact (e.g., directly or indirectly) the upper surface of sidewall 114 such that articles are prevented from passing to or from storage chamber 112.

In the closed position, lid 124 may define at least a portion of storage chamber 112 (e.g., above and over body volume 118). Thus, an inner or interior surface of lid 124 (e.g., at top wall 128) may define one or more vertical extrema of storage chamber 112 (e.g., opposite of bottom wall 116). In certain embodiments, the portion or volume of storage chamber 112 defined by lid 124 is less than the portion or volume of storage chamber 112 defined by case body 110 (e.g., body volume 118). Advantageously, case body 110 may securely hold or receive one or more stored articles therein while lid 124 is open (e.g., such that articles do not immediately spill out or slide from body volume 118 once lid 124 is moved to the open position).

In exemplary embodiments, lid 124 includes a peripheral rim 130 (e.g., extending from top wall 128). As shown, peripheral rim 130 may define one or more horizontal extrema of lid 124 (e.g., as would be defined in the closed position). Generally, peripheral rim 130 may extend toward case body 110. Specifically, peripheral rim 130 may extend downward from top wall 128 and generally along the vertical direction V (e.g., in the closed position). In some such embodiments, peripheral rim 130 horizontally bounds the upper surface of sidewall 114 when closed. Thus, peripheral rim 130 may be radially outward of at least a portion of sidewall 114.

Optional embodiments include one or more features for selectively maintaining lid 124 in the closed position or otherwise sealing lid 124 to case body 110. For instance, one or more latches 134, or other suitable mechanical fasteners, may be provided to selectively hold or lock lid 124 against case body 110 in the closed position. Additionally or alternatively, one or more sealing O-rings or gaskets 132 (FIGS. 6 and 7) may be provided between lid 124 and case body 110 seal the opening and prevent fluid from passing to/from storage chamber 112 in the closed position. For instance, a gasket 132 may be mounted on one of lid 124 (e.g., at peripheral rim 130) or case body 110 (e.g., at sidewall 114) the contact the other of lid 124 or case body 110 in the closed position.

Generally, one or more lighting assemblies 136 are attached to the lid 124 or case body 110 (i.e., one of lid 124 and case body 110) to selectively illuminate a portion of the portable storage case 100. For instance, as shown in the exemplary embodiments of FIGS. 2 through 7, lighting assemblies 136 are attached to lid 124. Generally, lighting assembly 136 includes one or more light sources 138 (e.g., LEDs, fluorescent bulb, incandescent bulbs, etc.) mounted to a support base 140 on (e.g., fixedly attached to) lid 124. For instance, light source 138 may be mounted on and secured to support base 140 via one or more suitable adhesives, soldered connections, mechanical fasteners, etc.

Support base 140 may include, for instance, a board having an upper face 142 (e.g., on which light source 138 is mounted) and a lower face 144 (e.g., opposite of light source 138). From upper face 142 to lower face 144, support base 140 may define one or more pairs of anchor apertures 146, 148 to receive a wire 150 (e.g., in electrical communication with light source 138). When assembled, wire 150 may be held or threaded through both a first anchor aperture 146 and a second anchor aperture 148 of a corresponding pair. Thus, a wire loop 152 may be formed (e.g., opposite the lower face 144). Moreover, an advantageously robust electrical and mechanical connection may be formed between wire 150 and light source 138 without requiring a discrete attachment element.

In some embodiments, support base 140 is attached to an inner or interior surface of portable storage case 100. As an example, support base 140 (or lighting assembly 136 generally) may be fixedly attached (e.g., via a suitable adhesive, mechanical fastener, etc.) to top wall 128 or peripheral rim 130. Notably, by attaching to peripheral rim 130, lighting assembly 136 may avoid limiting the size or volume of available storage space within storage chamber 112 (e.g., in the closed position). Moreover, peripheral rim 130 may notably provide an angled support directing lighting assembly 136 towards body volume 118 (e.g., the open position). In additional or alternative embodiments, support base 140 is positioned on an opposite lateral side or edge from the axis of rotation. Advantageously, lighting assembly 136 may be held at an upper vertical extreme of lid 124 in the open position.

In embodiments wherein multiple lighting assemblies 136 are attached to lid 124 or case body 110, one or more of the lighting assemblies 136 may be spaced part from each other horizontally (e.g., as would be defined in the closed position). In some embodiments, each lighting assembly 136 is horizontally spaced apart from one or more of the other lighting assemblies 136. In additional or alternative embodiments, multiple lighting assemblies 136 may be spaced apart along, for instance, peripheral rim 130. In other words, multiple lighting assemblies 136 may be mounted at discrete locations on peripheral rim 130. Advantageously, the lighting assemblies 136 may illuminate multiple locations of body volume 118 (e.g., along the transverse direction T) without interfering with the available storage space within storage chamber 112 in the closed position. In certain embodiments, multiple lighting assemblies 136 are in electrical communication with each other (e.g., via one or more wires 150 or communications busses), such as in electrical series or parallel.

The light sources 138 may be provided as a single-color source configured to selectively emit only a single illumination color (e.g., only white light, only green light, only blue light, or only red light), as would be defined on the visible color spectrum. Alternatively, one or more of light sources 138 may be provided as a multicolor light source 138 configured to selectively emit a plurality of illumination colors (e.g., white light, green light, blue light, or red light), as would be defined on the visible color spectrum. For instance, light source 138 of a lighting assembly 136 may be a multicolor LED, which may selectively vary the color of light emitted therefrom.

Generally, a power source 154 (e.g., one or more direct current batteries) is provided in electrical communication with lighting assembly/assemblies 136. For instance, a power source 154 may be provided on an electrical circuit (e.g., in electrical series or parallel) with one or more lighting assemblies 136 to selectively supply a voltage or electrical current thereto. In some embodiments, power source 154 is attached to the same lid 124 or case body 110 as lighting assemblies 136 (i.e., the one of lid 124 and case body 110). In the exemplary embodiments of FIGS. 2 through 7, power source 154 is mounted to top wall 128. Advantageously, all electrical wires, busses, and signal paths to/from power source 154 and lighting assembly 136 may be isolated on lid 124 or case body 110. All electrical connections with lighting assembly 136 or power source 154 may be limited to lid 124 or case body 110. In other words, no wires may be required to pass between lid 124 and case body 110. As an example, power source 154 may be attached to top wall 128.

In additional or alternative embodiments, power source 154 is spaced apart from lighting assembly 136 (e.g., horizontally as would be defined in the closed position). For instance, in the illustrated embodiments, power source 154 is located at a portion of lid 124 that directly covers a headstock portion of body volume 118 (e.g., shaped to receive a headstock of a guitar), while one or more lighting assemblies 136 are located at peripheral rim 130.

In some embodiments, a control board 156 including a user input 158 is attached to the same lid 124 or case body 110 as lighting assemblies 136 (i.e., the one of lid 124 and case body 110) in electrical communication with lighting assemblies 136 or power source 154. For instance, power source 154 may be mounted on control board 156 in electrical communication therewith. Additionally or alternatively, control board 156, with or without power source 154 may be attached to top wall 128 (e.g., at an inner or interior surface of top wall 128).

In additional or alternative embodiments, control board 156 is spaced apart from lighting assembly 136 (e.g., horizontally as would be defined in the closed position). For instance, in the illustrated embodiments, control board 156 is located at a portion of lid 124 that directly covers a headstock portion of body volume 118 (e.g., shaped to receive a headstock of a guitar), while one or more lighting assemblies 136 are located at peripheral rim 130.

As illustrated, control board 156 may have an upper face 142 (e.g., on which user input 158 is mounted) and a lower face 144 (e.g., opposite of user input 158). From upper face 142 to lower face 144 support base 140 may define one or more pairs of anchor apertures 146, 148 to receive a wire 150 (e.g., in electrical communication with user input 158 or power source 154). When assembled, wire 150 may be held or threaded through both a first anchor aperture 146 and a second anchor aperture 148 of a corresponding pair. Thus, a wire loop 152 may be formed (e.g., opposite the upper face 142). Moreover, an advantageously robust electrical and mechanical connection may be formed between wire 150 and user input 158 or power source 154 without requiring a discrete attachment element.

Generally, control board 156 is configured to selectively direct the voltage or current from power source 154 to lighting assembly/assemblies 136. A user input 158 (e.g., dial, button, toggle, etc.) may be included on control board 156 to control or adjust activation of a lighting assembly 136. Specifically, user input 158 may be configured to adjust activation of lighting assembly 136. For instance, by engaging user input 158, a user may be able to select an illumination pattern, color, or intensity of emissions from lighting assembly 136. In some such embodiments, user input 158 may be engaged to alternate between, for instance, a continuous activation pattern and a sequenced (e.g. flashing, strobing, or pulsating) pattern. In additional or alternative embodiments, user input 158 may be engaged to alternate between a plurality of predetermined illumination colors the emitted by lighting assembly 136. In further additional or alternative embodiments, user input 158 may be engaged (e.g., as a dimmer switch) to selectively adjust the voltage transmitted to lighting assembly 136, and thereby adjust the intensity of light emissions from lighting assembly 136.

In certain embodiments, a nonmechanical field switch 160 is provided in electrical communication with lighting assembly 136. For instance, nonmechanical field switch 160 may be provided along the same circuit as lighting assembly 136 and power source 154 or control board 156. Generally, nonmechanical field switch 160 may be configured to restrict or prevent activation of lighting assembly 136 in the closed position. In other words, nonmechanical field switch 160 may generally operate to open the circuit between power source 154 and lighting assembly 136 (or otherwise prevent the voltage to lighting assembly 136) in the closed position of lid 124. By contrast, in the open position, nonmechanical field switch 160 may close the circuit or otherwise permits the voltage to lighting assembly 136.

Generally, nonmechanical field switch 160 may be provided as any suitable switch configured to detect or otherwise react to a nonmechanical field in the closed position of lid 124. In exemplary embodiments, nonmechanical field switch 160 includes or is provided as a magnetic reed switch. A passive field element 162 such as a permanent magnet, may be provided on the portable storage case 100 to selectively engage magnetic reed switch in the closed position. In some such embodiments, nonmechanical field switch 160 is attached to one of lid 124 and case body while passive field element 162 is attached to an opposite of lid 124 case body 110. In other words, nonmechanical field switch 160 may be attached to lid 124 while passive field element 162 is attached to case body 110, and alternatively, nonmechanical field switch 160 may be attached to case body 110 while passive field element 162 is attached to lid 124. Thus, nonmechanical field switch 160 may be brought into and out of engagement with passive field element 162 as lid 124 is rotated between the closed position and the open position.

In exemplary embodiments, nonmechanical field switch 160 is attached to lid 124 at peripheral rim 130 (e.g., on support base 140 with one or more light sources 138). In additional or alternative embodiments, passive field element 162 is mounted above body volume 118 opposite bottom wall 116. For instance, passive field element 162 may be attached to a portion of internal wall 122 located above body volume 118 or, alternatively, directly to sidewall 114. Optionally, passive field element 162 may be horizontally aligned with nonmechanical field switch 160 in the closed position. Additionally or alternatively, passive field element 162 may be aligned along the circumference or periphery of case body 110. Thus, in the closed position, nonmechanical field switch 160 and passive field element 162 may be held proximate to each other at a common vertical height or circumferential location (e.g., about opening 120).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A portable storage case comprising:
a case body defining a storage chamber;
a lid rotatably mounted to the case body to move between an open position and a closed position, the open position permitting access to the storage chamber, the closed position restricting access to the storage chamber;
a lighting assembly attached to one of the lid and the case body, the lighting assembly comprising a light source and a support board;
a nonmechanical field switch in electrical communication with the lighting assembly to restrict activation of the lighting assembly in the closed position;
a control board attached to the one of the lid and the case body in electrical communication with the lighting assembly, the control board comprising a user input configured to adjust activation of the lighting assembly;
a power source mounted to the control board to supply power thereto; and
a passive field element attached to the other of the lid and the case body and engaged with the nonmechanical field switch in the closed position,
wherein the control board and the power source are spaced apart from the lighting assembly along an inner surface of the one of the lid and the case body.

2. The portable storage case of claim 1, wherein the lid comprises a peripheral rim extending toward the case body in the closed position, and wherein the lighting assembly is fixedly attached to the peripheral rim.

3. The portable storage case of claim 1, wherein the lighting assembly comprises a multicolor light source configured to selectively emit a plurality of illumination colors.

4. The portable storage case of claim 1, wherein the control board is held within the storage chamber in the closed position.

5. The portable storage case of claim 1, wherein the nonmechanical field switch comprises a magnetic reed switch.

6. The portable storage case of claim 1, wherein the case body comprises a sidewall and a bottom wall defining a body volume of the storage chamber, wherein the lid comprises a top wall positioned above the body volume, and wherein the passive field element is mounted above the body volume opposite the bottom wall.

7. The portable storage case of claim 6, wherein the body volume comprises a headstock portion, and wherein the control board and the power source are located on a portion of the top wall directly covering the headstock portion.

8. The portable storage case of claim 1, wherein the control board defines a first anchor aperture and a second anchor aperture spaced apart from the first anchor aperture along the control board, wherein the portable storage case further comprises a wire threaded through both the first anchor aperture and the second aperture, and wherein the wire defines a wire loop between the first anchor aperture and the second aperture.

9. A portable storage case comprising:

a case body defining a storage chamber;

a lid rotatably mounted to the case body to move between an open position and a closed position, the open position permitting access to the storage chamber, the closed position restricting access to the storage chamber;

a lighting assembly attached to the lid, the lighting assembly comprising a light source and a support board;

a nonmechanical field switch comprising a magnetic reed switch attached to the lid in electrical communication with the lighting assembly to restrict activation of the lighting assembly in the closed position;

a control board attached to the lid in electrical communication with the lighting assembly, the control board comprising a user input configured to adjust activation of the lighting assembly;

a power source mounted to the control board to supply power thereto; and a passive field element attached to the case body and engaged with the nonmechanical field switch in the closed position, wherein the control board and the power source are spaced apart from the lighting assembly along an inner surface of the lid, wherein the lid comprises a peripheral rim extending toward the case body in the closed position, and wherein the lighting assembly is fixedly attached to the peripheral rim.

10. The portable storage case of claim 9, wherein the lighting assembly comprises a multicolor light source configured to selectively emit a plurality of illumination colors.

11. The portable storage case of claim 9, wherein the control board is held within the storage chamber in the closed position.

12. The portable storage case of claim 11, wherein the case body comprises a sidewall and a bottom wall defining a body volume of the storage chamber, wherein the lid comprises a top wall positioned above the body volume, and wherein the passive field element is mounted above the body volume opposite the bottom wall.

13. The portable storage case of claim 12, wherein the body volume comprises a headstock portion, and wherein the control board and the power source are located on a portion of the top wall directly covering the headstock portion.

14. The portable storage case of claim 9, wherein the control board defines a first anchor aperture and a second anchor aperture spaced apart from the first anchor aperture along the control board, wherein the portable storage case further comprises a wire threaded through both the first anchor aperture and the second aperture, and wherein the wire defines a wire loop between the first anchor aperture and the second aperture.

15. A portable storage case comprising:

a case body defining a storage chamber;

a lid rotatably mounted to the case body to move between an open position and a closed position, the open position permitting access to the storage chamber, the closed position restricting access to the storage chamber;

a plurality of lighting assemblies attached to the lid, each lighting assembly of the plurality of lighting assemblies being spaced apart;

a nonmechanical field switch in electrical communication with the plurality of lighting assemblies to restrict activation of the plurality of lighting assemblies in the closed position;

a control board attached to the lid in electrical communication with the plurality of lighting assemblies, the control board comprising a user input configured to adjust activation of the plurality of lighting assemblies;

a power source mounted to the control board to supply power thereto; and a passive field element attached to the case body and engaged with the nonmechanical field switch in the closed position, and wherein the control board and the power source are spaced apart from the plurality of lighting assemblies along an inner surface of the lid.

16. The portable storage case of claim 15, wherein the lid comprises a peripheral rim extending toward the case body in the closed position, and wherein the plurality of lighting assemblies is fixedly attached to the peripheral rim.

17. The portable storage case of claim 15, wherein the plurality of lighting assemblies comprises a multicolor light source configured to selectively emit a plurality of illumination colors.

18. The portable storage case of claim 15, wherein the case body comprises a sidewall and a bottom wall defining a body volume of the storage chamber, wherein the lid comprises a top wall positioned above the body volume, wherein the body volume comprises a headstock portion, and wherein the control board and the power source are located on a portion of the top wall directly covering the headstock portion.

19. The portable storage case of claim 15, wherein the control board defines a first anchor aperture and a second anchor aperture spaced apart from the first anchor aperture along the control board, wherein the portable storage case further comprises a wire threaded through both the first anchor aperture and the second aperture, and wherein the wire defines a wire loop between the first anchor aperture and the second aperture.

* * * * *